US007870976B2

(12) United States Patent
Fazekas et al.

(10) Patent No.: US 7,870,976 B2
(45) Date of Patent: Jan. 18, 2011

(54) PRESSURIZED CAN WITH INNER SHELL

(76) Inventors: Gábor Fazekas, Fehérsas u. 21, H-1163, Budapest (HU); Hans Jürgen Werner, Lehmkuhle 22, 34414 Warburg (DE); Rideg Mihály, Apolló u. 2/A, H-1158, Budapest (HU)

( * ) Notice: Subject to any disclaimer, the term of this patent is extended or adjusted under 35 U.S.C. 154(b) by 749 days.

(21) Appl. No.: 11/596,660

(22) PCT Filed: Mar. 16, 2005

(86) PCT No.: PCT/EP2005/002782

§ 371 (c)(1),
(2), (4) Date: May 4, 2007

(87) PCT Pub. No.: WO2005/113383

PCT Pub. Date: Dec. 1, 2005

(65) Prior Publication Data

US 2007/0251954 A1 Nov. 1, 2007

(30) Foreign Application Priority Data

May 17, 2004 (DE) ..... 10 2004 024 777

(51) Int. Cl.
*B65D 83/14* (2006.01)

(52) U.S. Cl. ..... 222/135; 222/394; 222/402.1; 206/219; 206/222

(58) Field of Classification Search ..... 222/135, 222/130, 402.1, 136, 129, 394; 206/219, 206/222
See application file for complete search history.

(56) References Cited

U.S. PATENT DOCUMENTS 2,786,769 A * 3/1957 Greenspan ..... 426/117
2,793,776 A * 5/1957 Lipari ..... 206/221
4,323,177 A * 4/1982 Nielsen ..... 222/386
4,651,899 A * 3/1987 Pauls et al. ..... 222/130
4,769,395 A * 9/1988 Pauls ..... 521/99
5,011,047 A * 4/1991 Cruysberghs ..... 222/396
5,215,225 A * 6/1993 Kopp ..... 222/129
5,456,386 A * 10/1995 Jesswein ..... 222/136

(Continued)

FOREIGN PATENT DOCUMENTS

WO WO 84/01355 4/1984

*Primary Examiner*—Kevin P Shaver
*Assistant Examiner*—Donnell Long
(74) *Attorney, Agent, or Firm*—Berliner & Associates

(57) ABSTRACT

The invention relates to a pressurized can comprising a body, a valve arranged in a dome, a base (16), an inner shell (1) with detachable, push-off type cover (8) arranged on the base (16) and a movable shaft (7) arranged in a fixing element (2) and extending through the base (16) into the inner shell (1) and serving as release element for the inner shell with the inner shell (1) being connected to the base (16) via the fixing element (2), moreover comprising a piston element (3) movable in longitudinal direction of the inner shell (1) and being arranged inside the inner shell (1), the piston element yielding a sealing effect at the inner shell's (1) inner wall and interacting with the shaft (7) in such a manner that when the shaft (7) is moved into the inner shell (1) the piston element (3) causes a liquid present inside the inner shell (1) to be pressurized so that the cover (8) is forced off.

15 Claims, 5 Drawing Sheets

Figure 1:
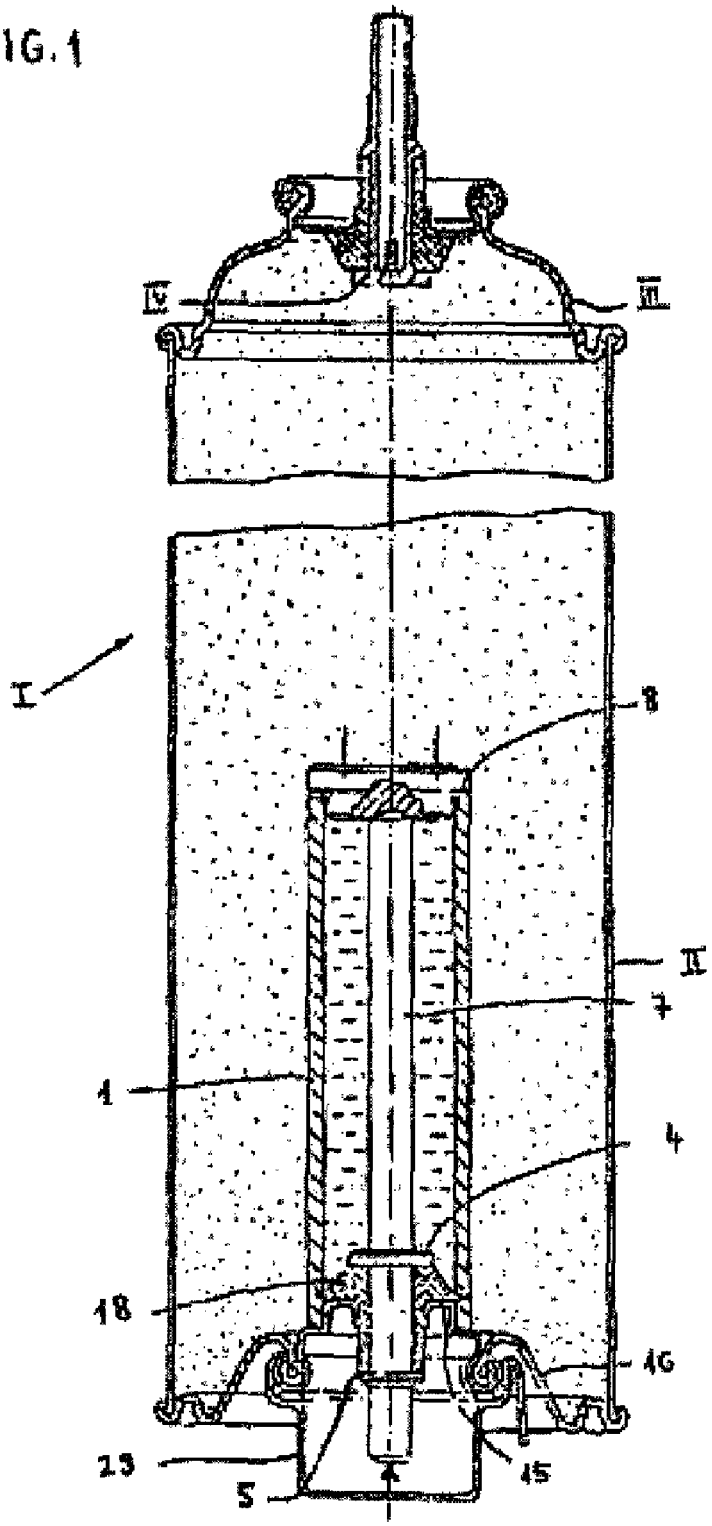

U.S. PATENT DOCUMENTS 5,638,992 A * 6/1997 Lim et al. ..... 222/129
5,692,644 A * 12/1997 Gueret ..... 222/80
5,884,759 A * 3/1999 Gueret ..... 206/222
6,247,586 B1 * 6/2001 Herzog et al. ..... 206/221
6,675,993 B2 * 1/2004 Morck ..... 222/399
6,997,357 B2 * 2/2006 Fuchs ..... 222/386
2002/0088724 A1 7/2002 Morck

* cited by examiner

PRIOR ART

PRESSURIZED CAN WITH INNER SHELL

The invention relates to a pressurized can comprising a body, a valve arranged in a dome, a base, an inner shell with detachable, push-off type cover arranged on the base and a movable shaft arranged in a retaining element and extending through the base into the inner shell and being part of the release mechanism for the inner shell with said inner shell being connected to the base via the retaining element. Such pressurized cans may, for example, be used to discharge two-component mounting foams or two-component paint materials.

The invention also relates to the design of pressurized cans which, in addition to the main component required to produce and expel polyurethane foams or paints, accommodate a second component in the inner shell, said second component reacting with the main component to form the finished product, the foam or paint material. Furthermore, the invention can also be used for two-component formulations that are intended for other purposes, e.g. for treating or finishing surfaces or producing glues.

The substances contained in the pressurized cans are as a rule liquid and consist of a prepolymer, customary additives and the liquid propellant that serves to discharge the contents from the pressurized can. The additional component is contained, in relatively small amount, in an inner shell and consists, in most cases, of a compound which reacts quickly with the main component, in the event of polyurethane prepolymers with reactive isocyanate groups, for example a cross-linking agent in the form of, perhaps, a hydroxy compound, an amine, as the case may be in conjunction with catalysts. The component contained in the inner shell serves to influence the curing process and the quality of the product, usually by accelerating the curing reaction. Just before the contents of the can are discharged the second component is released into the pressurized can, as the cover of the inner shell is forced open, and is mixed with the main component by shaking the can. The prepared mixture must then be expelled within a defined time span to avoid curing of the mixture inside the can.

A pressurized can with a one-piece base formed from a metal part is known from DE-U-82 27 229. The externally threaded neck of an additional container is placed in a cut-out in this base and clamped in position between a shoulder of the additional container and the inner rim of the cut-out in the base with the help of a nut screwed on from outside and an O-ring seal compressed by the action of the nut. The rod inside extending into the additional container is provided with and protected by a piston-shaped seal and designed as a shaft that turns, and is supported, inside the neck of the additional container. When the shaft is driven from outside, its inner end positively engages with the cover of the additional container, forcing it off against the internal can pressure.

The origin of the invention is WO-A-85/00157 which describes a pressurized can for dispensing single- or multi-component substances said can being provided, in its interior, with an additional container accommodating a further component. The inner container is provided with an inner cover which can be forced open by a rod extending inside the inner container from the base of the pressurized can. The rod is movably supported inside the additional container and introduced through a seal arranged in the beaded cup of the can base. A pressurized can of this nature is shown in FIG. 1.

Both prior-art pressurized cans require relatively sophisticated design and assembly efforts with the container as per DE-U-82 27 229 even being impaired by a relatively complicated mechanical construction. Although forcing off the cover against the relatively high internal pressure of the container is brought about by the rotating movement of the rod this is still a relatively troublesome operation and requires an intricate sealing system.

Although the pressurized can according to WO-A-85/00157 has in general proved its worth and in comparison to the utility model mentioned must no doubt be seen as an improvement, the extension of the rod through the rubber seal clamped into the beaded cup is nevertheless problematic and necessitates a rod geometry which cannot be considered optimum.

Furthermore, both prior-art pressurized cans have system-inherent sealing problems due to the pressure difference between outer prepolymer and curing components contained in the inner shell which will automatically build up after propellant has been filled in. During the can's storage period which actually may last several months this pressure difference reduces primarily due to the fact that the outer prepolymer penetrates into the inner shell. However, since this a rather slow process involving only minor amounts of material it does not impair the chemical reaction itself that causes the curing effect. What causes problems, nevertheless, is that this material deposits in the area of the seals and particularly in the area of the cover where it causes adhesion. Moreover, particles forming as a result of this will in the case of a two-component spray can negatively affect the quality of the paint coating thus produced.

It is, therefore, the object of the invention to advance the pressurized can design according to WO-A-85/00157 in such a manner that, on the one hand, the components of the inner shell can be assembled more easily into a captive and absolutely tight unit and, on the other, the problem of leakages is alleviated that arise between the ambient space of the aerosol can and the inner shell due to the pressure differential necessarily occurring in that area.

This objective is achieved by providing an aerosol can of the kind first referred to above which is characterized in that a piston element movable in longitudinal direction of the inner shell is arranged inside the inner shell, said element yielding a sealing effect at the inner shell's inner wall and interacts with the shaft in such a manner that when the shaft is moved into the inner shell the piston element causes a liquid present inside the inner shell to be pressurized so that the cover is forced off.

An important factor for the inventive pressurized can and, in particular, the inner shell's functional method is that the piston element is movably arranged inside the pressurized can. After filling the propellant mixture into the pressurized can which significantly raises the pressure within the ambient space of the pressurized can a pressure balancing can thus be brought about by just slightly displacing the piston element. The piston element moves upwards inside the inner shell until the pressure within the inner shell is the same as that prevailing in the ambient space of the can. In this manner the pressure difference is eliminated that caused prepolymer to ingress into the inner shell.

On the valve side, the inner shell is provided with a closing or cover element that may be fitted by form closure in an optional manner. On the periphery of the cover a sealing element, for example in the form of an O-ring, is arranged which is located and supported in a groove provided in the cover and fits into a groove arranged on the inner side of the inner shell. Other sealing variants are feasible as well. However, preferred here is a lip seal tightly contacting the inner wall of the inner shell and, if applicable, interacting with a circumferential groove or projection located there.

Arranged at the bottom end of the inner shell is the piston element which is preferably designed in a manner similar to that of the closure or cover element. Here as well a sealing element, preferably a lip seal, is located on the periphery of the piston element said seal acting against the inner wall of the inner shell. Expediently, no grooves or the like are provided on the inner wall in this case so as not to interfere with moving the piston element and enable it to be easily displaced to effect pressure balancing and forcing off the cover.

For the purpose of the invention the term "forcing off" or "force-off type" is meant to describe and refer to the action of pressing out, pushing out or detaching the closure element or cover arranged on the valve-side end of the inner shell. The term "release" shall denote the activation of the inner shell by forcing off the closure cap as a result of the shaft being actuated.

On its underside the piston element is preferably provided with a cylindrically shaped cut-out trough which the piston shaft or push rod extends and where it is supported. The shaft or push rod forms part of the release mechanism and is the movable element by means of which force is exerted from the outside of the can during the release action on the piston element and thus on the filling inside the inner shell, usually a more or less viscous liquid. As a result of the hydraulic pressure thus created the closure element or cover is forced off.

The shaft is thus the central element of the release mechanism but not the only one. Important is the more or less complete transmission of pressure exerted via the shaft that acts on the liquid present inside the inner shell. The invention is based on findings according to which a push rod extending up to the closure cap can be dispensed with altogether provided the pressure can be transmitted via the liquid inside the shell onto the closure cap. In fact, some of the problems encountered with prior-art pressurized cans are attributable to the relatively rigid configuration or linkage of the push rod and closure cap. The piston solution provided according to the invention permits the pressure to be balanced due to the piston element being slightly displaced into the inner shell as result of the pressure exerted by the prepolymer component present in the ambient space of the can. According to the invention the pressure is solely transmitted from the piston element to the closure cap by the liquid column in the inner shell.

The inner shell itself is mounted on a fixing element projecting through the can base and accommodating the shaft or push rod. Primarily, the fixing element serves for shaft guidance. It may, for example, be molded onto a beaded cup with said cup being part of the can base and attached to a concavely shaped base element by crimping. The base element itself is connected with the body of the can by crimping.

Alternatively, the fixing element may also extend through an opening centrally arranged in the can base which is particularly expedient in the case of drawn aluminum cans. Here, it is considered advantageous to provide a seal, for example a rubber sealing disk, located between a circumferential external projection of the fixing element and the inside of the can base. Fixing elements with seal are secured at the outside of the can base by means of a suitable securing element acting against the can base. Such a securing element may, for example, be a customary spring washer.

Inner shell and fixing element are connected with each other, for example by means of suitable snap-in elements. It may be useful to design this connection such that it has a sealing effect but this is usually not necessary; to simplify the balancing of pressure between can contents and inner shell contents it is expedient to permit the can contents to freely enter the lower space of the inner shell up to the piston element. For this purpose, openings in the shell wall may be provided in the bottom area below the piston.

Expediently, limiting elements may be provided on the shaft or push rod, in particular an inner limiting element that checks the downward movement of the shaft at the can base. This limiting element may also be designed to function as a sealing element acting against the inner wall of the fixing element. A circumferential projection located roughly at base element level serves as abutment for the limiting element and thus stops its downward movement. At the same time this projection has an additional sealing effect, all the more so when the limiting element is flexibly designed.

Outside the pressurized can the shaft may have another limiting element checking the upward movement of the shaft when the inner shell is released. This limiting action is appropriately effected by providing a projecting collar designed so as to brace itself against the circumferential projection located at base element level. To facilitate assembly it is recommendable to design this outer limiting element such that during assembly it can be pushed through or inserted from above, that is from the valve end, through the fixing element and its circumferentially arranged inner projection.

For cost reasons it may be expedient to provide for the closure or cover and piston element to be of identical design. In this case both the closure and piston elements are provided with the same seal, preferably a lip seal. A lip seal acting both in upward and downward direction against the inner wall offers an additional advantage in that piston and cover are correctly guided along the wall.

According to the invention the fixing element has a tubular configuration and provides for the shaft to extend from the piston element through the can base and on to the outside of the can. A circumferential outer projection serves to secure the fixing element at the can base, either by molding it onto the inner edge of the base element or by bracing it against the base element. A circumferential inner projection located roughly at the can base serves as abutment supporting the limiting elements that may be provided on the shaft.

The bottom end of the shaft outwardly projecting through the can base may appropriately engage with a sleeve capable of being actuated with a view to tripping the release mechanism. An upward movement of the sleeve causes the shaft including the piston element arranged above to be moved up as well, and in this way the closure element is pushed out or forced off as a result of the hydraulic pressure thus exerted. For this purpose the sleeve may, for example, be designed as push button expediently guided within a cylindrical guide element on the outer wall of the outer portion of the fixing element, or, for instance, supported, so as to be movable, in a cut-out provided in a cap arranged at the can base.

In accordance with a variant the fixing element has in its bottom-side portion a female thread arranged concentrically around the shaft into which a sleeve provided with a male thread engages. The bottom-side end of the shaft extends into a central bore provided in the screw-type sleeve. Turning the sleeve so that it moves into the fixing element thus causes shaft and piston element to move upwards to bring about the release of the inner shell.

To enable the turning movement to be effected more easily a cap may also provided here said cap interacting by force- and form-closure with the sleeve in a central cut-out or in a central shaft. To this effect the cap is expediently provided with a guide and engages with a circumferential groove arranged on the outside of the outer portion of the fixing element. The cap is designed so as to be turnable so that when a turning movement is performed the sleeve via its male thread portion moves into the fixing element.

Figure 2:
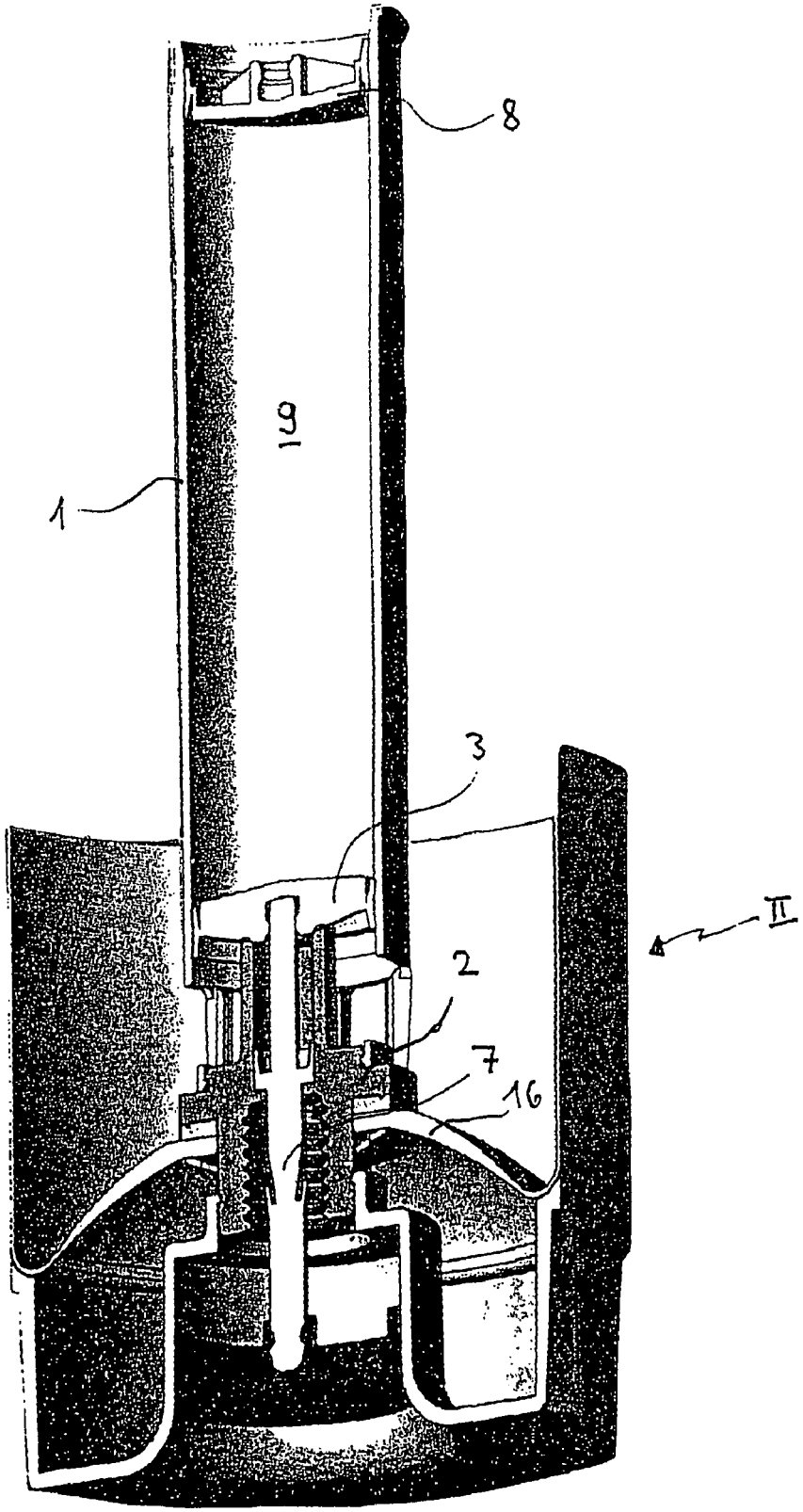
Figure 3:
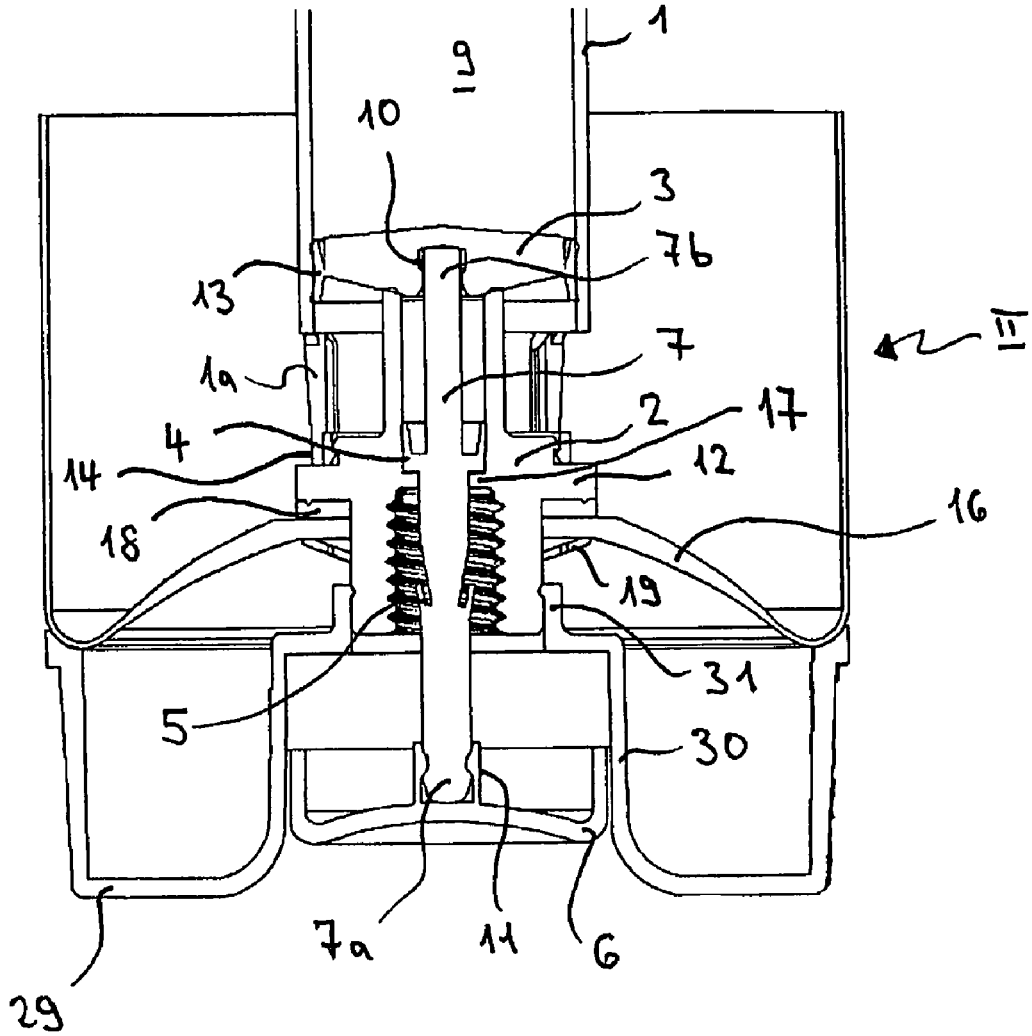
Figure 4:
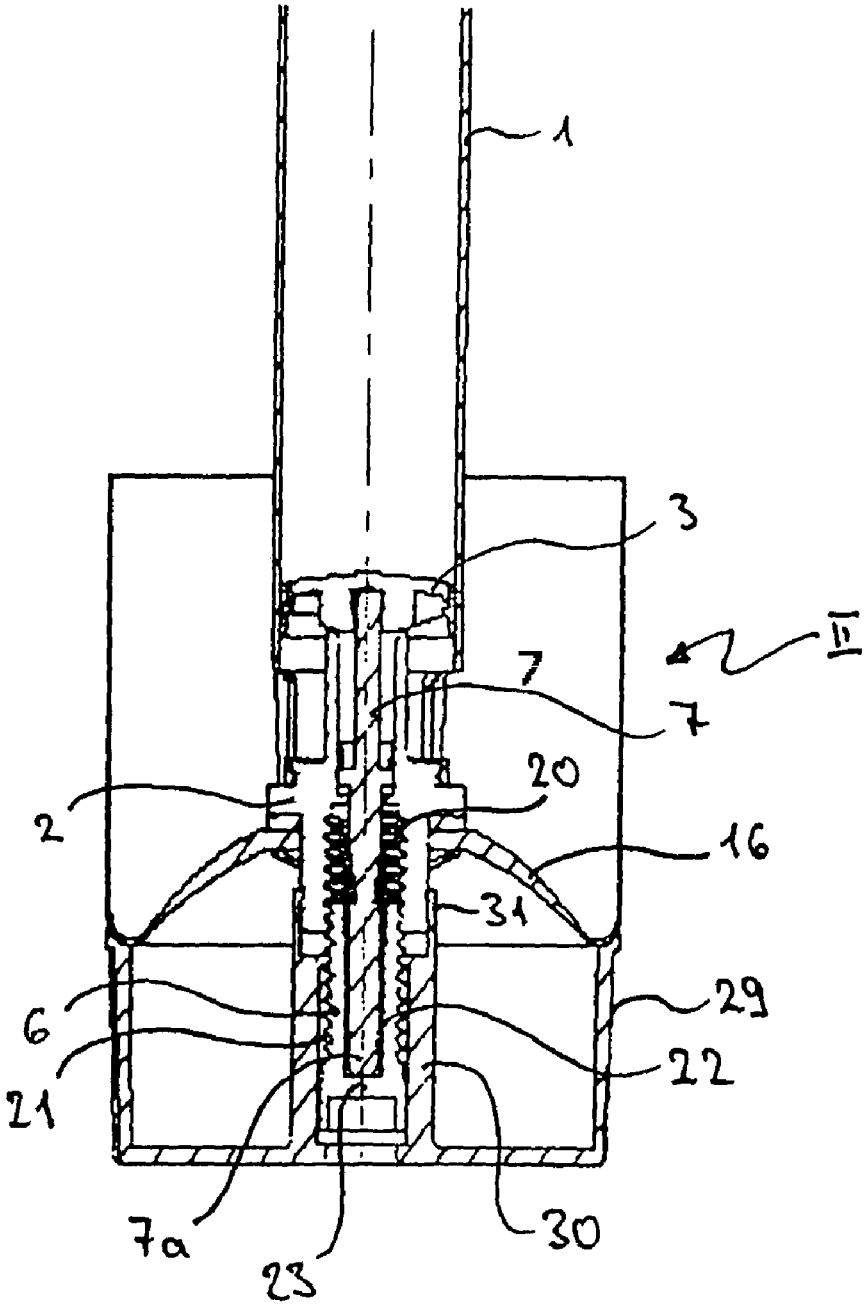

The invention is explained in more detail by way of the enclosed figures. They show in FIG. 1 a pressurized can with inner shell according to prior art (WO-A-85/00157);

FIG. 2 the bottom portion of an inventive pressurized can with concavely shaped base and mounted cap, as a sectional view;

FIG. 3 a sectional view of the embodiment illustrated in FIG. 2;

FIG. 4 another variant of the embodiments shown in FIG. 3, and

Figure 5:
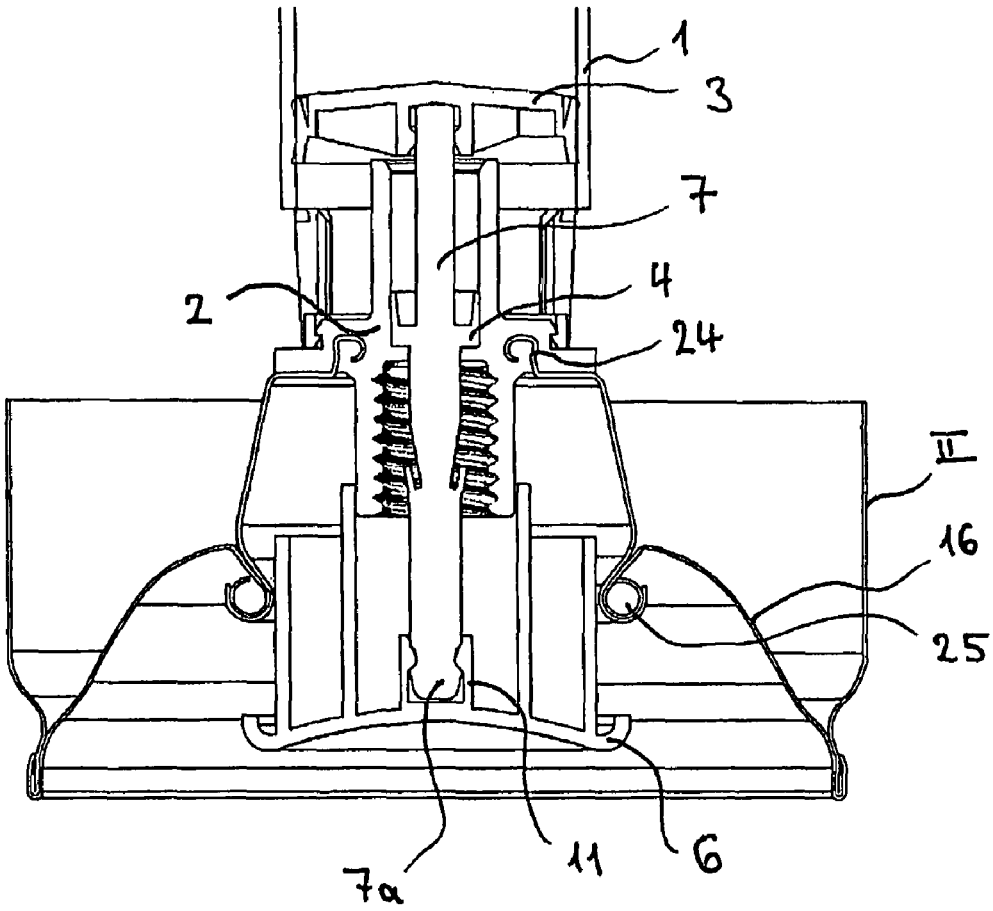

FIG. 5 an inner shell according to FIG. 2 provided with a molded-in beaded cup and a push button for release purposes.

The pressurized can I according to FIG. 1 consists of a body II, which is closed with a dome III at its upper end. The dome III is connected to the body II by means of interlocked flanges which provide also a tight seal between these components. The dome III is made from a round plate cut from sheet metal and formed into the domed shape shown on the drawing. The inner rim of the dome III is also provided with a flange by which it is joined to a valve cup holding a valve IV.

The base 16 is also joined to the body II by means of interlocked flanges and is equipped, in its center, with a beaded cup 15, above which the inner shell 1 is located. The inner shell 1 is provided with a cover 8 that can be forced off. Inside the inner shell 1 there is a push rod 7, whose end projects through a sealing element 18 from the base of the pressurized can and extends up to the cover 8. To both sides of sealing element 18 the push rod has limiting elements, an upper, inner one 4 and a lower, outer one 5, that both act against the sealing element 18 and restrict the free travel of the push rod 7 within the inner shell 1. For the purpose of forcing cover 8 off the inner shell or container 1 the push rod 7 is pressed in upward direction by striking the can base onto a firm surface. The rubber-elastic sealing element 18 absorbs this upward movement and, once the cover 8 has been forced off, pushes the push rod 7 back into its initial position. The end of the push rod is protected by cap 29.

FIG. 2 is a sectional representation of the lower portion of a aerosol can according to the invention. The preferred embodiment as per FIG. 2 shows the base area of the can body II with concavely shaped base element 16. The can in this case is a drawn (aluminum) pressurized can. Inside the pressurized can there is the inner shell 1, the inner space 9 of which is limited by closure cap 8 and piston element 3. The inner shell 1 is secured at fixing element 2 by means of a latch-type connection. The fixing element itself extends to the outside through the base 16 of the pressurized can and is secured at said base by means of a circumferential projection, a sealing disk and a spring washer. Shaft 7 has an upper and a lower limiting element said elements acting against a internal circumferential projection arranged inside fixing element 2. Upon actuation of shaft 7 through pressure being exerted on the button located outside the pressurized can, piston 3 is moved towards closure cap 8 thus pressurizing the liquid contained in space 9 which results in the hydraulic pressure thus created pushing out or forcing off the closure cap 8 of the inner shell 1.

In the base area of the pressurized can a cap has been provided the cylindrical guide element of which engages with the end of the fixing element 2 projecting through the can base with said cap resting on the outer end of the concavely shaped portion of the pressurized can. The sunk-in cavity in the bottom area serves to secure the cap to the fixing element and also as vertical guide for the push button.

FIG. 3 is a sectional view of the lower portion of the representation shown in FIG. 2.

As illustrated in FIG. 3 the piston element 3 has been provided with lip seal 13 acting against the inner wall of the inner shell 1. Moreover, since this type of seal has an upper and lower lip segment a certain additional guiding effect is thus achieved at the wall that facilitates the piston movement.

The piston element has a central hollow space 10 designed so as to accommodate the shell-side end 7*b* of the shaft 7. The base-side end of shaft 7 is formed into head segment 7*a* which engages with a recess 11 provided on the sleeve/push button 6.

In its central portion shaft 7 is provided with two limiting elements 4 and 5 of which the inner one 4 also serves as an elastic seal acting against the inner wall of fixing element 2. The limiting element on the base side has been designed to form an elastic collar open towards the valve end. Both limiting elements interact with a circumferential projection 17 located on the inner side of the fixing element said projection having an intercepting function restricting the upward or downward movement of shaft 7, especially when the inner shell is released. The circumferential projection 17 also serves as seat for limiting element 4 in its function as sealing element. The distance between limiting elements 4 and 5 coincides with the maximum length of travel of shaft 7 available for the release of the inner shell.

Fixing element 2 is a plastic molding having a continuous bore through which the shaft 7 extends. A circumferential outer projection 12 under which a sealing disk 18 has been arranged serves to secure the base element 16 in the area of its central cut-out. At the can base the fixing element is secured with the aid of a fastening element, in this case a spring washer 19.

At location 14 the inner shell 1 engages via molded-on stems 1*a* and with the help of a snap-on element with a circumferential groove provided in fixing element 2. Since sealing of the pressurized can towards the outside is brought about by projection 17 and element 4 and towards the inner shell by lip seal 13 on piston element 3 the hollow space of inner shell 1 below piston element 3 is freely accessible to the contents present in the ambient can space. This facilitates the balancing of pressure between ambient space and shell space 9, in particular when propellant gas is filled in.

In the lower aperture portion the fixing element 2 is provided with a female thread that may be of significance for other embodiments, refer to FIG. 4.

In the area of the can base a cap 29 is arranged which has a sunk-in central cavity 30 provided on one shoulder with a cylindrical neck 31 said neck being engaged with the lower end of fixing element 2 via an inner circumferential projection on the neck and a groove in said element. The sunk-in cavity 30 has vertical walls also serving as guide for push button 6 by means of which shaft 7 is pressed into the can interior when the inner shell is released.

FIG. 4 shows a variant of the embodiment illustrated in FIG. 3 said variant having on the base-side end of fixing element 2 a threaded structure 20 interacting with a threaded sleeve 6 provided with male thread 21. Threaded sleeve 6 has a bore 22 accommodating the base-side end of shaft 7 abutting with its end portion 7*a* against the bottom 23 of threaded sleeve 6.

The threaded sleeve 6 itself fits into a receptacle 30 such that a form closure is created, for example by means of a hexagonal structure. Cap 29 via a projection 31 of hollow-cylinder shape below base element 16 engages with fixing element 2. This engagement is designed in such a manner that the cap 29 can be turned and simultaneously brings about the rotational movement of sleeve 6 so that sleeve 6 threads into the female thread located at the base-side end of fixing element 2 and in this manner causes shaft 7 with piston element 3 to be driven into the inner shell. The rotational movement of cap 29 thus results in the inner shell 1 being released.

FIG. 5 shows a variant of a pressurized can according to the invention the can base 16 of which is provided with an additional beaded cup 17. Beaded cups of this type are used in particular for pressurized cans made of tinplate. The beaded cup itself is attached on its outside to base 16 at location 25 by crimping. In the area of the inner opening the fixing element 2 has been molded in such a manner that the partially flanged inner rim 24 of beaded cup 17 is entirely embedded in the plastic compound of fixing element 2.

Similar to the embodiment as per FIG. 3 the base-side end of shaft 7 is supported in a receptacle 11 of a sleeve or push button 6 which is to be pushed towards the can base in order to actuate the release mechanism. For this purpose the push button 6 with an internally molded hollow cylinder is guided along the outer wall of fixing element 2 and at its outer wall along crimping seam 25 by means of which beaded cup 17 is attached to base element 16.

The invention claimed is:

1. Pressurized can comprising a body, a valve arranged in a dome, a base (16), an inner shell (1) with detachable, push-off type cover (8) arranged on the base (16) and a movable shaft (7) arranged in a fixing element (2) and extending through the base (16) into the inner shell (1) and serving as release element for the inner shell with said inner shell (1) being connected to the base (16) via the fixing element (2) characterized in that a piston element (3) movable in longitudinal direction of the inner shell (1) is arranged inside the inner shell (1), said piston element (3) yielding a sealing effect at the inner shell's (1) inner wall and interacting with the shaft (7) in such a manner that when the shaft (7) is moved into the inner shell (1) the piston element (3) causes a liquid present inside the inner shell (1) to be pressurized so that the cover (8) is forced off wherein the piston element (3) has a central recess (10) in which a can-side end (7*b*) of the shaft (7) is secured.

2. Pressurized can according to claim 1, characterized in that the fixing element (2) is arranged, preferably by molding, on a beaded cup (15) located and crimped onto base (16).

3. Pressurized can according to claim 1, characterized in that the fixing element (2) is secured via a securing element (19) in an opening of base (16) with a sealing element (18) being arranged between base (16) and a circumferential outer projection (12) of fixing element (2).

4. Pressurized can according to claim 3, characterized in that the securing element (19) is a spring washer.

5. Pressurized can according to any one of claims 1 to 4, characterized in that shaft (7) has an inner limiting element (4) which interacts with a circumferential inner projection (17) of fixing element (2).

6. Pressurized can according to claim 5, characterized in that the shaft (7) has also been provided with an outer limiting element (5).

7. Pressurized can according to claim 1, characterized in that the inner shell (1) engages with fixing element (2).

8. Pressurized can according to claim 1, characterized in that the piston element (3) and the closure cover (8) are of identical design.

9. Pressurized can according to claim 1, characterized in that the piston element and/or the closure cover (8) are provided with lip seals (13) acting against the inner wall of the inner shell (1).

10. Pressurized can according to claim 1, characterized in that on outer end (7*a*) of the shaft (7) engages with a sleeve (6) which can be actuated to cause an upward movement of the shaft (7) and the piston element (3).

11. Pressurized can according to claim 10, characterized in that the sleeve (6) has an inner guide (30) concentrically encompassing that part of fixing element (2) located outside the pressurized can.

12. Pressurized can according to claim 10, characterized in that the fixing element (2) is provided with a female thread (20) on its portion located outside the pressurized can, said female thread encompassing shaft (7) concentrically.

13. Pressurized can according to claim 12, characterized in that sleeve (6) has a male thread (21) interacting with the female thread (20) thus driving the shaft (7) into the inner shell (1) when the sleeve (6) is rotated and thus moved into the fixing element (2).

14. Pressurized can according to claim 1, characterized in that the can has been provided with a cap (29) secured at the base of the pressurized can or fixing element (2) and being provided with a central recess and opening accommodating a release mechanism.

15. Pressurized can according to claim 14, characterized in that the cap (29) is designed so as to be rotatable with said cap in the area of the central recess being connected with a sleeve (6) in a form- and force-closed manner.

* * * * *